US005288458A

United States Patent [19]

McDevitt et al.

[11] Patent Number: 5,288,458

[45] Date of Patent: Feb. 22, 1994

[54] MACHINABLE COPPER ALLOYS HAVING REDUCED LEAD CONTENT

[75] Inventors: David D. McDevitt, Greenwood, Ind.; Jacob Crane, Woodbridge, Conn.; John F. Breedis, Trumbull, Conn.; Ronald N. Caron, Branford, Conn.; Frank N. Mandigo, North Branford, Conn.; Joseph Saleh, Branford, Conn.

[73] Assignee: Olin Corporation, New Haven, Conn.

[21] Appl. No.: 907,473

[22] Filed: Jul. 1, 1992

Related U.S. Application Data

[63] Continuation-in-part of Ser. No. 662,876, Mar. 1, 1991, Pat. No. 5,137,685.

[51] Int. Cl.[5] ..... C22C 9/00

[52] U.S. Cl. ..... 420/477; 420/478; 420/491

[58] Field of Search ..... 420/477, 478, 491

[56] References Cited

U.S. PATENT DOCUMENTS

| | | | |
|---|---|---|---|
| 2,246,328 | 3/1961 | Smith | 175/366 |
| 2,975,255 | 3/1961 | Laferty | 200/144 |
| 3,246,979 | 4/1966 | Laferty | 75/134 |
| 3,805,000 | 4/1974 | Roy | 200/144 B |
| 4,180,398 | 12/1979 | Parikh | 420/477 |
| 4,551,395 | 11/1985 | Lloyd | 420/470 |
| 4,786,469 | 11/1988 | Weber et al. | 420/469 |
| 4,865,805 | 9/1989 | Holowaty | 420/85 |
| 4,879,094 | 11/1989 | Rushton | 420/476 |
| 5,167,726 | 12/1992 | LoIacono et al. | 148/432 |

FOREIGN PATENT DOCUMENTS

| | | | |
|---|---|---|---|
| 45-27216 | 9/1970 | Japan . | |
| 54-135618 | 10/1979 | Japan . | |
| 0097443 | 7/1980 | Japan | 420/477 |
| 0133357 | 6/1986 | Japan . | |
| 467126 | 4/1975 | U.S.S.R. . | |
| 581903 | 10/1946 | United Kingdom . | |
| 1157636 | 7/1969 | United Kingdom . | |
| 1157652 | 7/1969 | United Kingdom . | |

OTHER PUBLICATIONS

Consumer Reports, Feb. 1993, pp. 73–78.

Washington Post "Wash Home Section", p. 5 Feb. 25, 1993.

Flemings, Merton C. "Solidification Processing" published by McGraw-Hill, Inc. 1974 at pp. 252–258.

Plewes, John T. et al. entitled "Free-Cutting Copper Alloys Contain No Lead" appearing in Advanced Materials and Processes, Oct. 1991 at pp. 23–27.

Blazey, Clement, entitled "Brittleness in Copper" appearing in The Journal of the Institute of Metals, at vol. XLVI 1931, at pp. 353–383.

Eborall, entitled "Some Observations of the Mode of Occurrence of Selenium, Tellurium and Bismuth in Copper" appearing in The Journal of the Institute of Metals, at vol. LXX, 1944 at pp. 435–446.

Voce et al., entitled "The Mechanism of the Embrittlement of Deoxidized Copper by Bismuth" appearing in The Journal of the Institute of Metals, at vol. LXXIII, 1947 at pp. 323–376.

Schofield et al., entitled "The Microstructure of Wrought Non-Arsenical Phosphorous-Deoxidized Copper Containing Small Quantities of Bismuth" appearing in The Journal of the Institute of Metals, at vol. LXXIII 1947 at pp. 377–384.

Samuels, entitled "The Metallography of Copper Containing Small Amounts of Bismuth" appearing in The Journal of the Institute of Metals at vol. LXXVII 1949–1950 at pp. 91–101.

(List continued on next page.)

*Primary Examiner*—Upendra Roy

*Attorney, Agent, or Firm*—Gregory S. Rosenblatt; Paul Weinstein

[57] ABSTRACT

Machinable alpha beta brass having a reduced lead concentration is claimed. The alloy contains bismuth to improve machinability. Either a portion of the zinc is replaced with aluminum, silicon or tin, or a portion of the copper is replaced with iron, nickel or manganese.

18 Claims, 4 Drawing Sheets

OTHER PUBLICATIONS

Price et al. entitled "Bismuth—Its Effect on the Hot--Working and Cold-Working Properties of Alpha and Alpha-Beta Brasses" appearing in Transactions of A.I.M.E. (1942) at pp. 136-143.

Smith, entitled "Grains, Phases and Interfaces: An Interpretation of Microstructure" appearing in Transactions of A.I.M.E. (1984) at pp. 15-51.

Bishop, "Lead-Free Copper Alloy for Plumbing Developed by AT&T's Bell Laboratories" appearing in The Wall Street Journal, May 15, 1991.

Feder, entitled "A New Form of Brass to Cut Lead in Drinking Water" appearing in The New York Times, May 15, 1991 at p. D7.

Oya et al. Rept. Casting Res. Lab. Waseda University, No. 30, 1979, p. 93.

Chemical Abstracts 91: 95313v (vol. 91) 1979 at p. 95317.

Chemical Abstracts 106: 37311c (vol. 106) 1987 at p. 270.

U.S. Senate Bill 2637 (101st Congress, 2D Session), 1990 at p. 36 entitled "Title IV—Lead Exposure Reduction".

Gordon et al., Science, vol. 223 entitled "Bismuth Bronze from Machu Picchu, Peru" (Feb. 10, 1984) at p. 585.

Chang et al., "Phase Diagrams and Thermodynamic Properties of Ternary Copper Metal Systems" appearing in INCRA Monograph VI—The Metallurgy of Copper, Feb. 15, 1979 at pp. 253-263 and 669-683.

MACHINABLE COPPER ALLOYS HAVING REDUCED LEAD CONTENT

CROSS REFERENCE TO RELATED APPLICATION

This application is a continuation-in-part of U.S. patent application Ser. No. 07/662,876 by D.D. McDevitt et al. which was filed on Mar. 1, 1991, now U.S. Pat. No. 5,137,685.

BACKGROUND OF THE INVENTION

This invention relates generally to machinable copper alloys. More particularly, the invention relates to modified leaded brasses having at least a portion of the lead replaced with bismuth and a portion of the copper or zinc replaced with another element.

DESCRIPTION OF RELATED ART

Free machining copper alloys contain lead or other additions to facilitate chip formation and the removal of metal in response to mechanical deformation caused by penetration of a cutting tool. The addition to the alloy is selected to be insoluble in the copper based matrix. As the alloy is cast and processed, the addition collects both at boundaries between crystalline grains and within the grains. The addition improves machinability by enhancing chip fracture and by providing lubricity to minimize cutting force and tool wear.

Brass, a copper-zinc alloy, is made more machinable by the addition of lead. One example of a leaded brass is alloy C360 (nominal composition by weight 61.5% copper, 35.5% zinc and 3% lead). The alloy has high machinability and acceptable corrosion resistance. Alloy C360 is commonly used in environments where exposure to water is likely. Typical applications include plumbing fixtures and piping for potable water.

The ingestion of lead is harmful to humans, particularly children with developing neural systems. To reduce the risk of exposure, lead has been removed from the pigments of paints. It has now been proposed in the United States Senate to reduce the concentration of lead in plumbing fittings and fixtures to a concentration of less than 2% lead by dry weight. There is, accordingly, a need to develop machinable copper alloys, particularly brasses, which meet the reduced lead target.

One such alloy is disclosed in U.S. Pat. No. 4,879,094 to Rushton. The patent discloses a cast copper alloy which is substantially lead free. The alloy contains, by weight, 1.5–7% bismuth, 5–15% zinc, 1–12% tin and the balance copper. The alloy is free machining and suitable for use with potable water. However, the alloy must be cast and is not wrought.

A wrought alloy is desirable since the alloy may be extruded or otherwise mechanically formed into shape. It is not necessary to cast objects to a near net shape. Wrought alloy feed stock is more amenable to high speed manufacturing techniques and generally has lower associated fabrication costs than cast alloys.

Another free machining brass is disclosed in Japanese Patent Application 54-135618. The publication discloses a copper alloy having 0.5–1.5% bismuth, 58–65% copper and the balance zinc. The replacement of lea with bismuth at levels up to 1.5% will not provide an alloy having machinability equivalent to that of alloy C360.

SUMMARY OF THE INVENTION

Accordingly, it is object of the invention to provide a machinable brass which is either lead free or has a reduced lead content. It is a feature of the invention that bismuth is added to the brass. Yet another feature of the invention is that the bismuth may form a eutectic with other elemental additions. Still another feature is that at least a portion of the copper or zinc in the brass matrix is replaced with another element.

In a second embodiment of the invention, a spheroidizing agent is added to the alloy. It is another feature of the invention that rather than a bismuth alloy, a sulfide, selenide or telluride particle is formed. It is an advantage of the invention that by proper processing, the sulfides, selenides or tellurides spheroidize rather than form stringers.

Another feature of the invention is that calcium and manganese compounds can be added to the alloy as lubricants for improved machinability. Other lubricating compounds such as graphite, talc, molybdenum disulfide and hexagonal boron nitride may be added.

Yet another advantage of the invention is that in addition to brass, the additives of the invention improve the machinability of other copper alloys such as bronze and beryllium copper.

In accordance with the invention, there is provided a machinable copper alloy. In a first embodiment, the copper alloy is an alpha/beta brass containing copper, zinc, a partial zinc substitute and bismuth. In a second embodiment, the copper alloy is an alpha/beta brass containing copper, a partial copper substitute, zinc and bismuth.

The above-stated objects, features and advantages will become more clear from the specification and drawings which follow.

DESCRIPTION OF THE INVENTION

Figure 1:
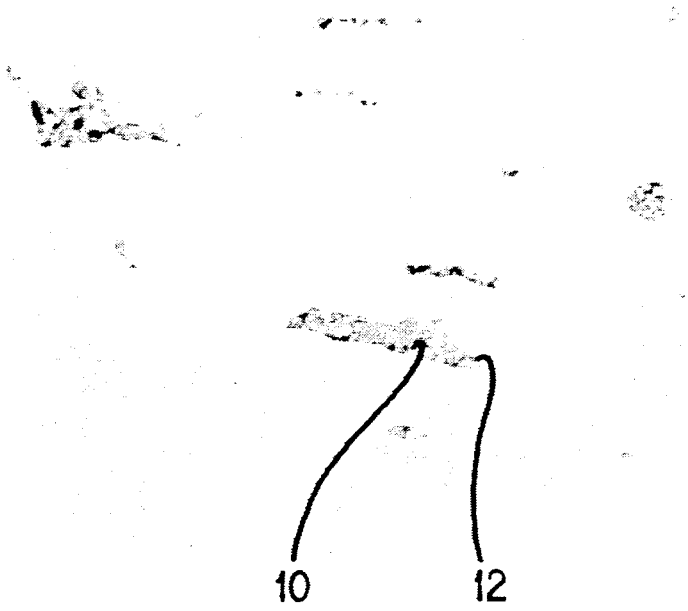
FIG. 1 is a photomicrograph showing the bismuth-lead eutectic.

Binary copper-zinc alloys containing from about 30% to about 58% zinc are called alpha-beta brass and, at room temperature, comprise a mixture of an alpha phase (predominantly copper) and a beta phase (predominantly Cu-Zn intermetallic). Throughout this application, all percentages are weight percent unless otherwise indicated. The beta phase enhances hot processing capability while the alpha phase improves cold processability and machinability. In potable water applications, the zinc concentration is preferably at the lower end of the alpha/beta range. The corresponding higher concentration of copper inhibits corrosion and the higher alpha content improves the performance of cold processing steps such as cold rolling. Preferably, the zinc concentration is from about 30% to about 45% zinc and most preferably, from about 32% to about 38% zinc.

A copper alloy, such as brass, having alloying additions to improve machinability is referred to as a free machining alloy. The additions typically either reduce the resistance of the alloy to cutting or improve the useful life of a given tool. One such addition is lead. As described in U.S. Pat. No. 5,137,685, all or a portion of the lead may be substituted with bismuth.

Table 1 shows the effect of machinability of bismuth, lead, and bismuth/lead additions to brass. The brass used to obtain the values of Table 1 contained 36% zinc, the specified concentration of an additive and the balance copper. Machinability was determined by measuring the time for a 0.25 inch diameter drill bit under a load of 30 pounds to penetrate a test sample to a depth of 0.25 inches. The time required for the drill bit to penetrate alloy C353 (nominal composition 62% Cu, 36% Zn and 2% PB) was given a standard rating of 90 which is consistent with standard machinability indexes for copper alloys. The machinability index value is defined as calculated form the inverse ratio of the drilling times for a fixed depth. That is, the ratio of the drilling time of alloy C353 to that of the subject alloy is set equal to the ratio of the machinability of the subject alloy to the defined machinability value of C353 (90).

$$\text{Machinability}_{(Subject\ Alloy)} = \frac{90 \times \text{Machining Time}_{C353}}{\text{Machining Time}_{(Subject)}} \quad 1$$

TABLE 1

| | Addition | Machinability Index |
|---|---|---|
| | 0.5% Pb | 60, 85 |
| | 1% Pb | 78, 83 |
| (C353) | 2% Pb | 90 (by definition) |
| | 3% Pb | 101, 106 |
| | 1% Bi | 83, 90 |
| | 2% Bi | 93, 97 |
| | 1% Pb-0.5% Bi | 85, 88 |
| | 1% Pb-1% Bi | 102, 120 |
| | 1% Pb-2% Bi | 100, 104 |

*Two sample of each alloy were tested, both calculated values recorded.

As illustrated in Table 1, increasing the bismuth concentration increases machinability. Preferably, the bismuth concentration is maintained below a maximum concentration of about 5 weight percent. Above 5% bismuth, processing is inferior and corrosion could become a problem. The minimum acceptable concentration of bismuth is that which is effective to improve the machinability of the copper alloy. More preferably, the bismuth concentration is from about 1.5% to about 3% and, most preferably, the bismuth concentration is from about 1.8% to about 2.2%.

Combinations of lead and bismuth gave an improvement larger than expected for the specified concentration of either lead or bismuth. In a preferred embodiment of the invention, rather than the addition of a single element, combinations of elements are added to brass to improve machinability.

In one embodiment of the invention, the bismuth addition is combined with lead. This is advantageous because while decreased lead content is desirable for potable water, it would be expensive to scrap or refine all existing lead containing brass. The existing lead containing alloys may be used as feed stock in concert with additions of copper, zinc and bismuth to dilute the lead. When a combination of lead and bismuth is employed, the lead concentration is maintained at less than 2%. Preferably, the bismuth concentration is equal to or greater in weight percent than that of lead. Most preferably, as illustrated in Table 1, the bismuth-to-lead ratio by weight is about 1:1.

FIG. 1 shows a photomicrograph of the brass sample of Table 1 having a 1%Pb-2%Bi addition. The sample was prepared by standard metallographic techniques. At a magnification of 1000X, the presence of a eutectic phase 10 within the bismuth alloy 12 is visible. The formation of a dual phase particle leads to the development of an entire group of alloy additions which should improve the machinability of brass.

The presence of a Pb-Bi eutectic region within the grain structure improves machinability. The cutting tool elevates the temperature at the point of contact. Melting of the Pb-Bi lubricates the point of contact decreasing tool wear. Additionally, the Pb-Bi region creates stress points which increase breakup of the alloy by chip fracture.

Table 2 illustrates the eutectic compositions and melting points of bismuth containing alloys which may be formed in copper alloys. It will be noted the melting temperature of several of the eutectics is below the melting temperature of either lead, 327° C., or bismuth, 271° C.

TABLE 2

| Bi—X System | Eutectic Melting Point | Weight % Bismuth |
|---|---|---|
| Bi—Pb | 125° C. | 56.5 |
| Bi—Cd | 144° C. | 60 |
| Bi—Sn | 139° C. | 57 |
| Bi—In | 72° C. | 34 |
| Bi—Mg | 551° C. | 58.9 |
| Bi—Te | 413° C. | 85 |

It is desirable to maximize the amount of eutectic constituent in the second phase particle. The Bi-X addition is selected so the nominal composition of the particle is at least about 50% of the eutectic. More preferably, at least about 90% of the particle is eutectic. By varying from the eutectic composition in a form such that the lower melting constituent is present in an excess, the machinability is further improved.

In addition to binary eutectics, ternary eutectics and higher alloy systems are also within the scope of the invention.

While the addition of bismuth to improve machinability have been particularly described in combination with brass, the machinability of other copper based matrices is also improved by the additions of the invention. Among the other matrices improved are copper-tin, copper-beryllium, copper-manganese, copper-zinc-aluminum, copper-zinc-nickel, copper-aluminum-iron, copper-aluminum-silicon, copper-manganese-silicon, copper-zinc-tin and copper-manganese-zinc. Other leaded copper alloys such as C544 (nominal composition by weight 89% copper, 4% lead, 4% tin and 3% zinc) may be made with a lower lead concentration by the addition of bismuth.

The effect of bismuth on machinability also occurs in alpha beta brass having a portion of the copper, zinc or both matrix elements partially replaced. Suitable replacements include one or more metallic elements which substitute for the copper or zinc in the alloy matrix. Preferred zinc substitutes include aluminum, tin and silicon and preferred copper substitutes include nickel, manganese and iron.

When a portion of the zinc is replaced, the amount of zinc substitute and the ratio of zinc to zinc substitute is governed by the phase transformations of the alloy. At hot working temperatures, typically around 600° C. or above, sufficient beta phase should be present to minimize hot shorting. At room temperature, the amount of beta phase is intentionally minimized for improved cold ductility. The appropriate zinc and zinc substitute composition is determined from the ternary phase diagram.

Figure 2:
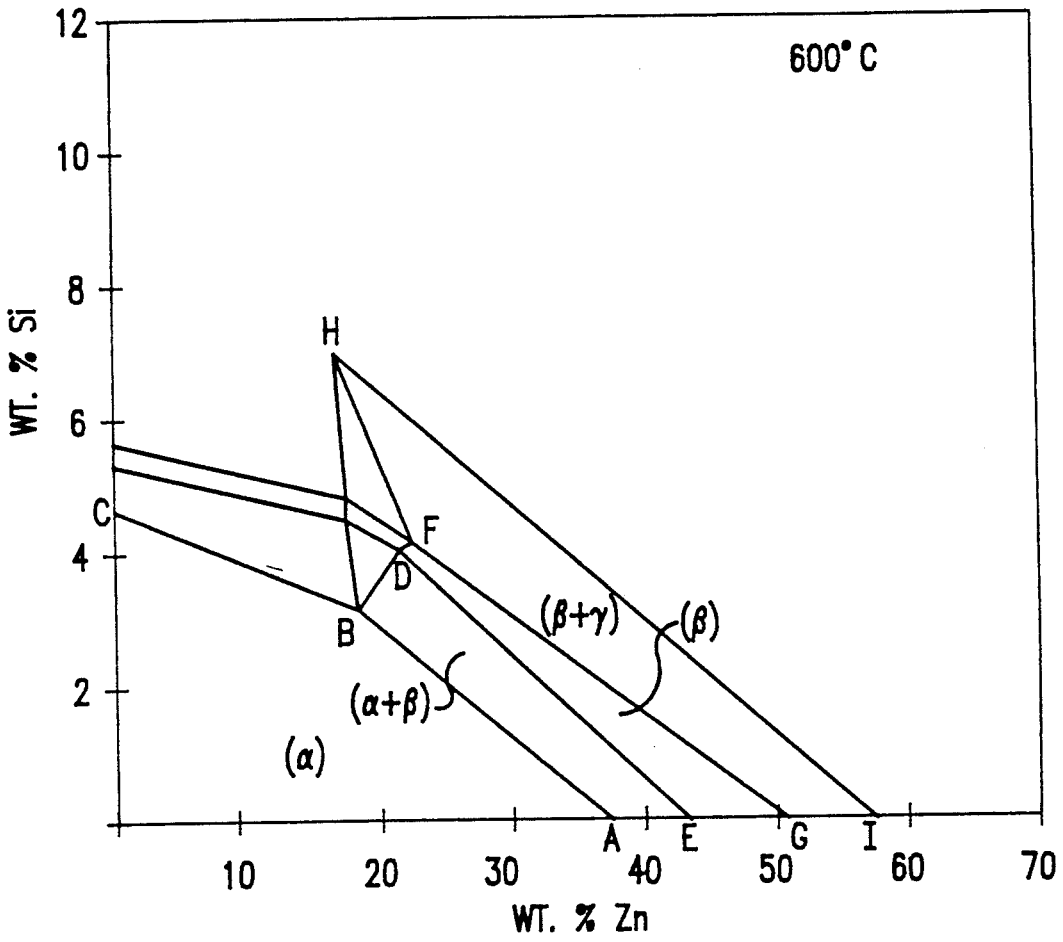
FIG. 2 illustrates a portion of the Cu-Si-Zn phase diagram defining the alpha/beta region.

FIG. 2 illustrates the relevant portion of the copper-silicon-zinc ternary phase diagram at 600° C. Silicon as a replacement for zinc increases the strength of the alloy. The alpha phase region is bordered by line ABC and the axes. The compositional region for a mixture of alpha and beta is delineated by ABDE. The predominantly beta region is defined by EDFG. A beta plus gamma region is defined by GFHI. The presence of bismuth, lead, and the other machinability improving additions is ignored in determining the composition of the brass matrix. The phase diagram illustrates the percentage of zinc and the zinc replacement necessary to be in the alpha/beta regime at 600° C., for example. Sufficient copper is present to achieve 100 weight percent. The bismuth, lead or other addition is added as a subsequent addition and not part of the mathematical calculations.

For hot working, the weight percent of zinc and silicon is that defined by the beta rich region defined by ABHI. The broadest compositional range of the copper-zinc-silicon-bismuth alloys of the invention have a zinc and silicon weight percent defined by ABHI and sufficient copper to obtain a weight percent of 100%. Bismuth is then added to the alloy matrix in an amount of from that effective to improve machinability up to about 5%.

While a high concentration of beta is useful for hot working the alloys, a predominantly alpha phase is required for cold workability. The preferred zinc and silicon content is defined by the region ABFG and the most preferred content by the region ABDE.

Figure 3:
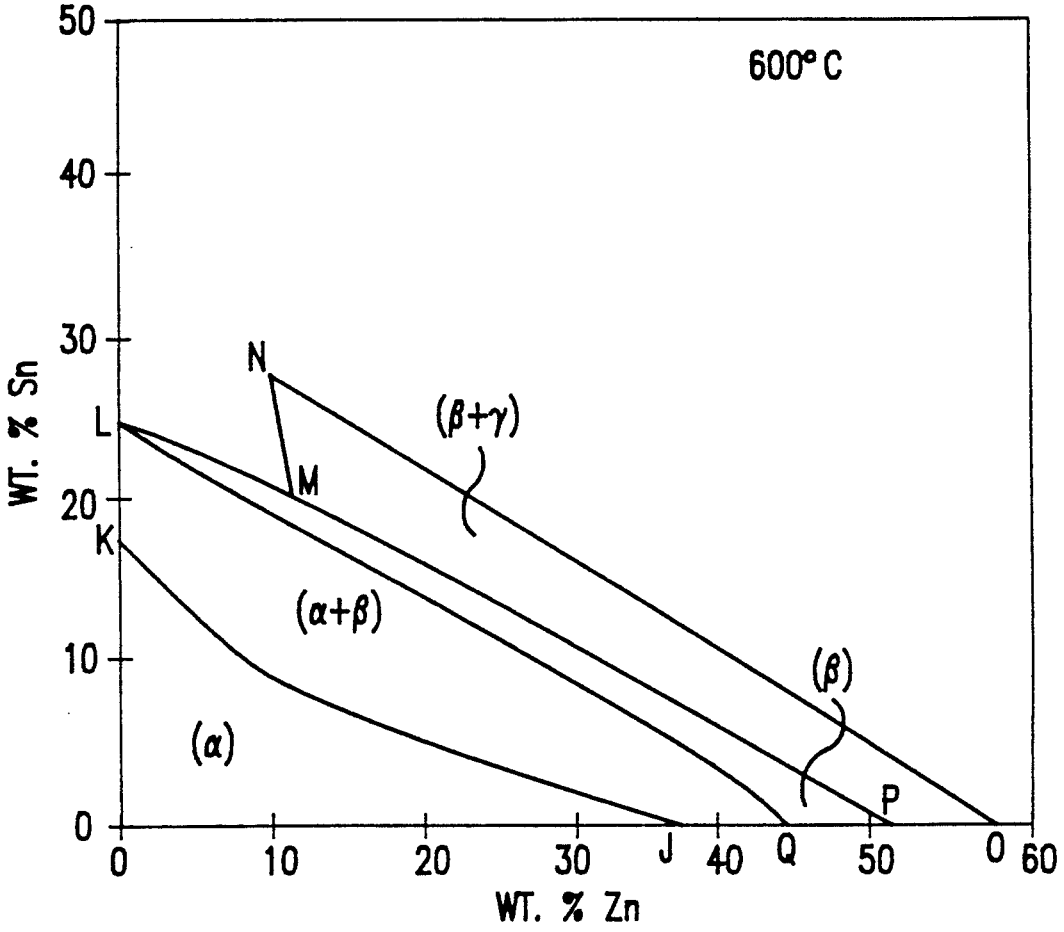
FIG. 3 illustrates a portion of the Cu-Sn-Zn phase diagram defining the alpha/beta region.

When a portion of the zinc is replaced by tin, the alloy is characterized by improved corrosion resistance. The compositional ranges of tin and zinc are defined by the 600° C. phase diagram illustrated in FIG. 3. The broadest range comprises from a trace up to about 25% tin with both the percentage and ratio of tin and zinc defined by region JKLMNO. A more preferred region to ensure a large quantity of alpha phase is the region JKLP. A most preferred compositional range is defined by JKLQ.

Figure 4:
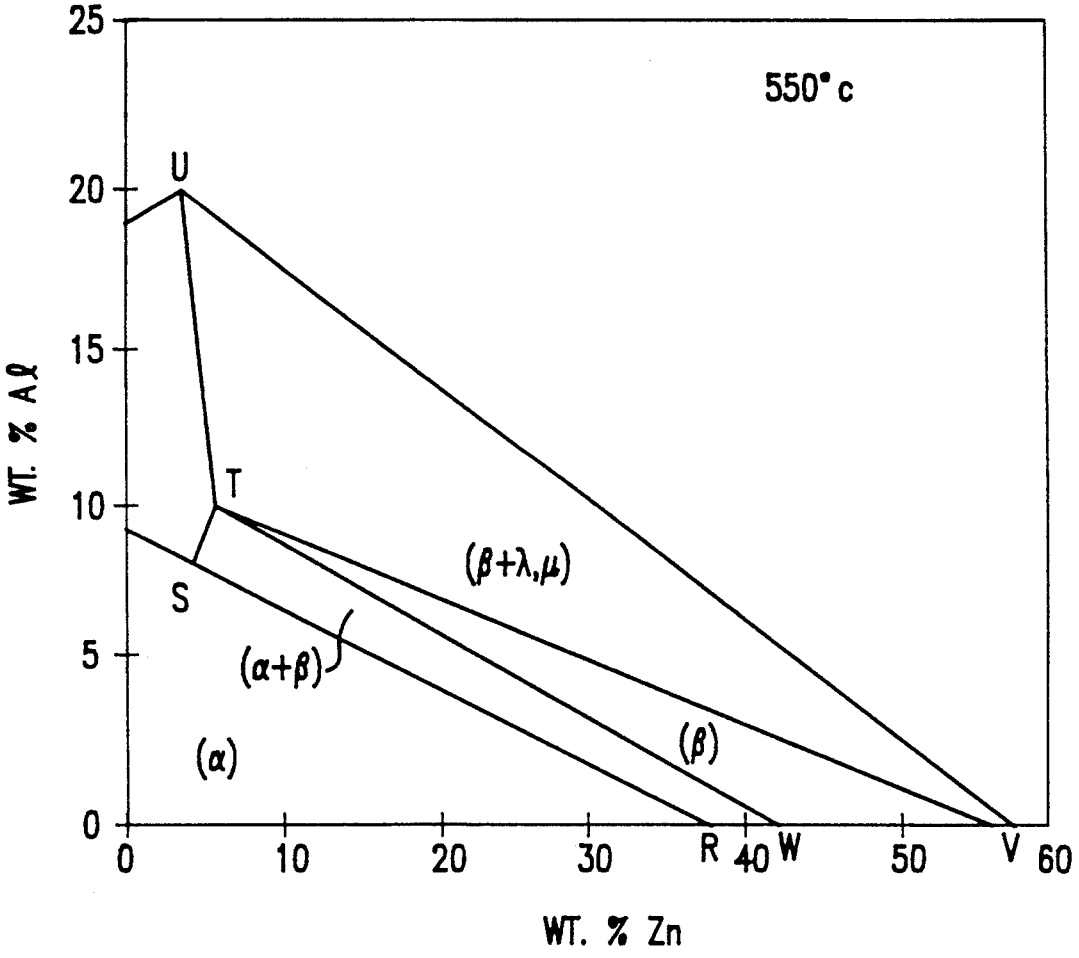
FIG. 4 illustrates a portion of the Cu-Al-Zn phase diagram defining the alpha/beta region.

FIG. 4 illustrates the 550° C. phase diagram for the ternary alloy in which a portion of the zinc is replaced with aluminum. The substitution of zinc with aluminum provides the alloy with both improved corrosion resistance and a slight increase in strength. The broad compositional range of zinc and aluminum is established by the region RSTUV. The more preferred range is defined by the region RSTV and the most preferred range by the region RSTW.

Other elemental additions replace a portion of the copper rather than the zinc. These substitutions include nickel which can be added for cosmetic reasons. The nickel gives the alloy a whiter color, the so called "nickel silvers" or "German silvers". Iron or manganese provide the alloy with a slight increase in strength and facilitate the use of larger quantities of scrap in casting the melt, reducing cost. From about a trace up to 4% by weight of either iron or manganese or mixtures thereof may be added to the alpha beta brass as a 1:1 replacement for copper. A more preferred concentration of iron, manganese or a mixture thereof is from about 0.5% to about 1.5%. Subsequent to calculating the replacement addition, bismuth is added in an amount from that effective to improve machinability up to about 5%. The more preferred concentration of iron or manganese is from about 0.5 to about 2%. While the preferred bismuth range is from about 1.8 to 3%.

Nickel or manganese may be added in the range of from a trace to about 25% as a 1:1 replacement for copper. The preferred nickel range is from about 8% to 18%. The bismuth range is similar to that utilized in the iron and manganese replaced alloys.

Mixtures of nickel and manganese can also replace some or all of the zinc One such an alloy is disclosed in U.S. Pat. No. 3,772,092 to Shapiro et al., as containing 12.5%-30% nickel, 12.5%-30% manganese, 0.1%-3.5% zinc and the balance copper. Other additions such as 0.01%-5% magnesium, 0.001%-0.1% boron or 0.01%-5% aluminum may also be present.

While the disclosed alloys are predominantly quaternary, it is within the scope of the invention to further include any additional unspecified additions to the alloy which impart desirable properties. The addition need not be metallic, and may take the form of a particle uniformly dispersed throughout the alloy.

The bismuth, lead or other machinability aid added to the brass matrix can take the form of discrete particles or a grain boundary film. Discrete particles uniformly dispersed throughout the matrix are preferred over a film. A film leads to processing difficulties and a poor machined surface finish.

A spheroidizing agent can be added to encourage the particle to become more equiaxed. The spheroidizing agent is present in a concentration of from an effective amount up to about 2 weight percent. An effective amount of a spheroidizing agent is that which changes the surface energy or wetting angle of the second phase. Among the preferred spheroidizers are phosphorous, antimony and tin. The spheroidizing agents may be added to either bismuth or any of the eutectic compositions disclosed in Table 2 above. A more preferred concentration is from about 0.1% to about 1%.

In copper alloys other than brasses, for example alloy C725 (nominal composition by weight 88.2% Cu, 9.5% Ni, 2.3% Sn), zinc may be added as a spheroidizing agent. The zinc is present in an effective concentration up to about 25% by weight.

A sulfide, telluride or selenide may be added to the copper matrix to improve machinability. The addition is present in a concentration effective to improve machinability up to about 2%. More preferably, the concentration is from about 0.1% to about 1.0%. To further enhance the formation of sulfides, tellurides and selenides, an element which combines with these latter three such as zirconium, manganese, magnesium, iron, nickel or mischmetal may be added.

Alternatively, copper oxide particulate in a concentration of up to about 10% by weight may be added to the matrix to improve machinability.

When brass is machined, the tool deteriorates over time due to wear. One method of improving tool life is to provide an addition to the alloy which lubricates the tool minimizing wear. Preferred tool coating additions include calcium aluminate, calcium aluminum silicate and magnesium aluminum silicate, graphite, talc, molybdenum disulfide and hexagonal boron nitride. The essentially lead-free additive is preferably present in a concentration of from about 0.05% percent by weight to about 2%. More preferably, the additive is present in a concentration of from about 0.1% to about 1.0%.

Some of the coating elements which improve cutting are not readily cast from the melt. A fine distribution of particles may be achieved by spray casting the desired alloy A liquid stream of the desired alloy, or more preferably, two streams (one of which may be solid particles), for example, brass as a first stream and calcium silicate as a second stream, are atomized by impingement with a gas. The atomized particles strike a collecting surface while in the semisolid form. The semisolid particles break up on impact with the collecting surface, forming a coherent alloy. The use of two adjacent streams with overlapping cones of atomized particles forms a copper alloys having a second phase component which generally cannot be formed by conventional casting methods.

The patents and publication set forth in the application are intended to be incorporated herein by reference.

It is apparent that there has been provided in accordance with this invention, copper alloys having improved free machinability with a reduced lead concentration which fully satisfy the objects, means and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. An alpha/beta brass comprising:

copper, zinc, a partial zinc substitute and from about 1.8% to about 5.0% by weight bismuth, said zinc and zinc substitute present in an amount sufficient to form an amount of beta phase effective to minimize hot shorting said alpha/beta brass having been hot worked at temperatures above about 600° C. and an amount of alpha phase present at room temperature effective to provide cold workability.

2. The alpha/beta brass of claim 1 wherein said zinc substitute is selected from the group consisting of aluminum, silicon, tin and mixtures thereof.

3. The alpha/beta brass of claim 2 wherein said zinc substitute is silicon and the weight percent of zinc and silicon is defined by the region ABHI.

4. The alpha/beta brass of claim 2 wherein the zinc substitute is tin and the weight percent of zinc and tin are defined by the region JKLMNO.

5. The alpha/beta brass of claim 2 wherein the zinc substitute is aluminum and the weight percent of zinc and aluminum are defined by the region RSTUV.

6. The alpha/beta brass of claim 3 wherein the zinc substitute is silicon and the weight percent of zinc and silicon is defined by the region ABFG.

7. The alpha/beta brass of claim 4 wherein he zinc substitute is tin and the weight percent of zinc and tin are defined by the region JKLP.

8. The alpha/beta brass f claim 5 wherein the zinc substitute is aluminum and the weight percent of zinc and aluminum are defined by the region RSTV.

9. The alpha/beta brass of claim 6 wherein he zinc substitute is silicon and the weight percent of zinc and silicon is defined by region ABDE.

10. The alpha/beta brass of claim 7 wherein he zinc substitute is tin and the weight percent of zinc and tin is defined by the region JKLQ.

11. The alpha/beta brass of claim 8 wherein the zinc substitute is aluminum and the weight percent of zinc and aluminum are defined by the region RSTW.

12. The alpha/beta brass of any one of claims 6, 7 or 8 wherein up to 2 weight percent of the bismuth is replaced with lead.

13. An alpha/beta brass consisting essentially of:

copper;

zinc;

a partial zinc substitute selected from the group consisting of aluminum, silicon, tin and mixtures thereof, said zinc and zinc substitute being present in an amount sufficient to form an amount of beta phase effective to minimize hot shorting said alpha/beta brass having been hot worked at temperatures above about 600° C. and an amount of alpha phase present at room temperature effective to provide cold workability; and from about 1.8% to about 5.0% by weight bismuth.

14. The alpha/beta brass of claim 13 wherein said brass includes up to about 2 weight percent of a spheroidizing agent selected from the group consisting of phosphorous, antimony, tin and mixtures thereof.

15. The alpha/base brass of claim 13 wherein said brass includes an addition which forms a eutectic with bismuth, said addition selected from the group consisting of lead, cadmium, tin, indium, magnesium and tellerium.

16. The alpha/beta brass of claim 14 wherein said zinc substitute is silicon and the weight percent of zinc and silicon is defined by the region ABDE in FIG. 2.

17. The alpha/beta brass of claim 14 wherein te zinc substitute is tin and the weight percent of zinc and tin are defined by the region JKLQ in FIG. 3.

18. The alpha/beta brass of claim 4 wherein the zinc substitute is aluminum and the weight percent of zinc and aluminum are defined by the region RSTW in FIG. 4.

* * * * *